US005301829A

United States Patent [19]

Chrisco

[11] Patent Number: 5,301,829

[45] Date of Patent: Apr. 12, 1994

[54] COMBINATION FUEL CONTAINER AND TOOL TRAY

[75] Inventor: Larry L. Chrisco, Fairland, Okla.

[73] Assignee: Blitz U.S.A., Inc., Miami, Okla.

[21] Appl. No.: 36,367

[22] Filed: Mar. 24, 1993

[51] Int. Cl.[5] ..... B65D 21/02

[52] U.S. Cl. ..... 220/521; 220/23.83; 220/326; 220/756; 220/771; 215/10; 215/100 A; 206/373; 206/216; 206/514

[58] Field of Search ..... 206/514, 501, 372, 373, 206/216; 215/1 C, 1 R, 6, 10, 100 A; 220/23.83, 23.86, 521, 4.14, 4.26, 4.27, 503, 324, 326, 625, 694, 729, 756, 771

[56] References Cited

U.S. PATENT DOCUMENTS

| | | | |
|---|---|---|---|
| D. 278,031 | 3/1985 | Elmburg . | |
| D. 279,549 | 7/1985 | Elmburg . | |
| D. 305,504 | 1/1990 | Fischer et al. . | |
| 3,326,358 | 6/1967 | Singleton | 215/6 |
| 3,463,353 | 8/1969 | Peebles | 206/514 |
| 3,835,482 | 9/1974 | Tersch | 220/608 |
| 4,078,701 | 3/1978 | Clubb | 206/501 |
| 4,224,765 | 9/1980 | Song | 220/326 |
| 4,412,633 | 11/1983 | Guerrazzi et al. | 215/100 A |
| 5,011,013 | 4/1991 | Meisner et al. | 206/514 |
| 5,056,424 | 10/1991 | Lai | 220/23.86 |
| 5,117,979 | 6/1992 | Brightbill | 206/501 |

*Primary Examiner*—Allan N. Shoap
*Assistant Examiner*—S. Castellano
*Attorney, Agent, or Firm*—Hovey, Williams, Timmons & Collins

[57] ABSTRACT

A fuel can is provided which includes a receptacle for receiving fuel or other liquid therein and a tray for holding other items, the tray being complementally configured with the bottom of the receptacle whereby the tray and receptacle may be releasably coupled in mating engagement. The tray and receptacle are provided with coupling structure which includes a pair of bosses on one component and a pair of latch members on the other component, the bosses and latch members being preferably integrally formed with the tray and receptacle. The latch member is resilient and yieldable during engagement of the tray and receptacle whereby a hook on the latch member engages a respective boss and spreads the latch members apart and then resiliently snaps into position on the to hold the tray and receptacle in coupled relationship. The tray and receptacle are preferably molded of synthetic resin material and the tray is preferably provided with a handle extending normally upwardly from the center of the base to provide additional support for the bottom wall of the receptacle when the latter is filled with liquid.

3 Claims, 4 Drawing Sheets

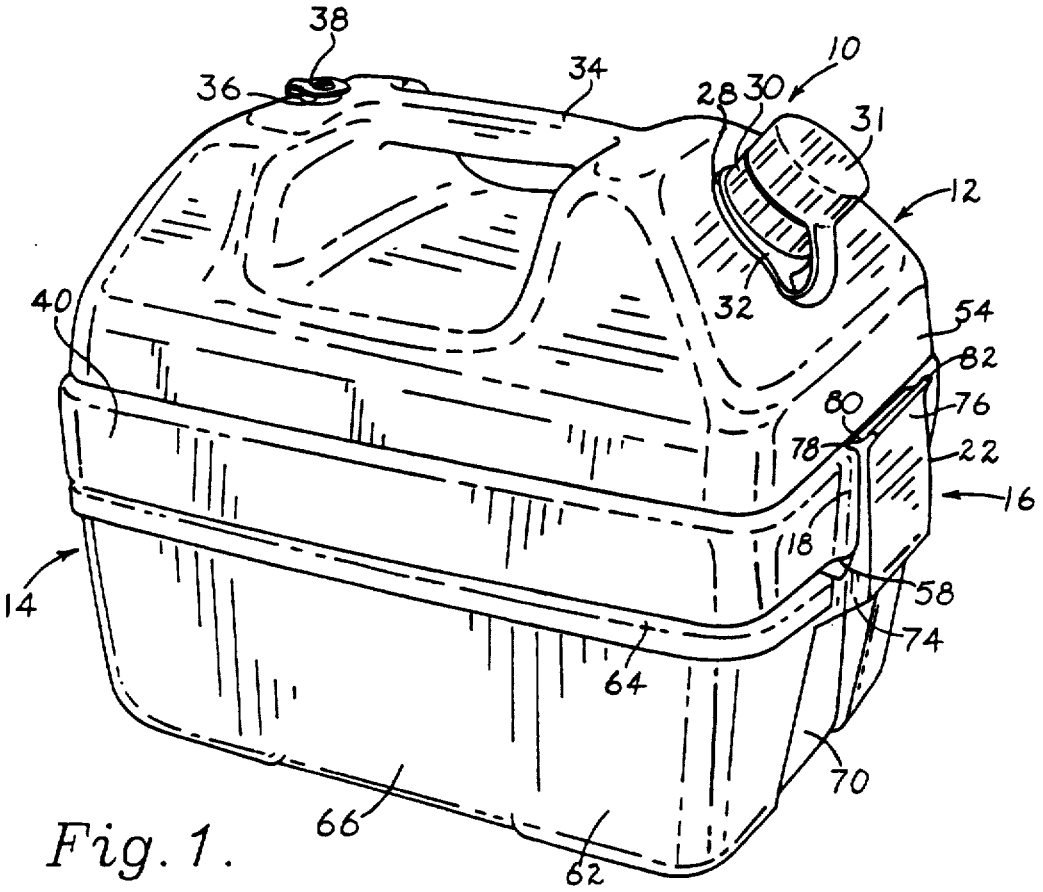
Fig. 1.
Fig. 2.
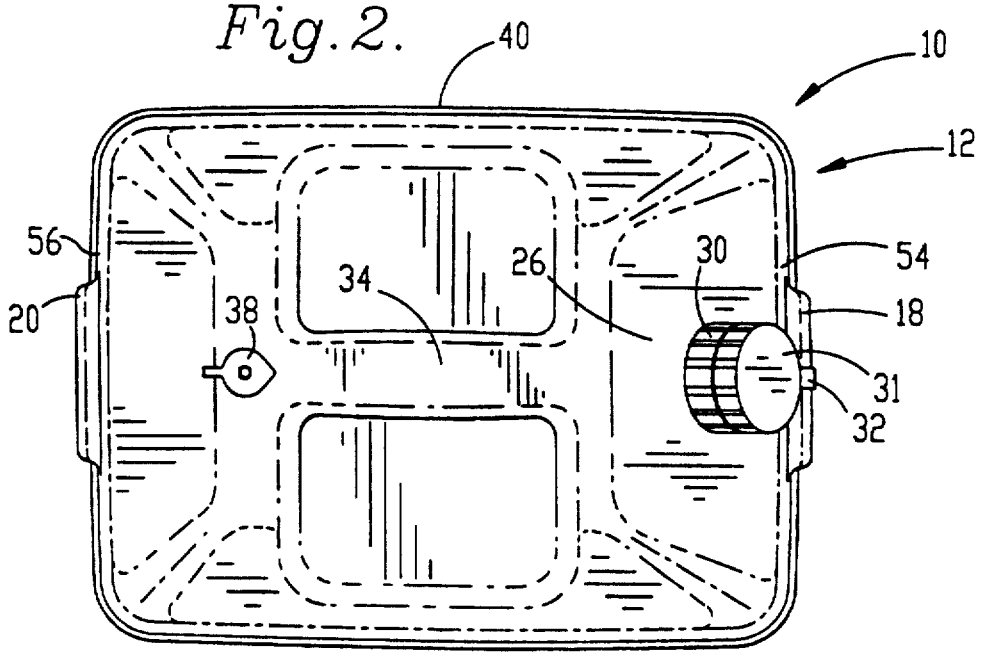

COMBINATION FUEL CONTAINER AND TOOL TRAY

BACKGROUND OF THE INVENTION

1. Field of the Invention

This invention concerns a fuel can which includes an upper receptacle configured for nesting with a lower tray, including coupling structure which resiliently yields to hold the tray to the receptacle. The tray preferably includes a centrally located handle for carrying the tray when separated and supporting the bottom of the receptacle when the latter is filled with liquid and coupled to the tray.

2. Description of the Prior Art

A number of different types of fuel cans are used for carrying gasoline, kerosine and other fuels. These cans typically are formed of metal or plastic, and include a spout for convenience in pouring the contents into a gas tank.

More recently, a fuel can which includes separate top and bottom portions has been developed which are configured for mating engagement. These "combination" fuel cans are proven quite convenient as they allow a single container to be used for fuel in the top portion and tools, lubricants, and other items to be stored in the bottom portion. These "combination" fuel cans have been fabricated of metal and include hasps for holding the top and bottom components together. Such a "combination" fuel can is shown, for example, in U.S. Pat. No. D 279,549.

While these "combination" fuel containers represent distinct advances in the art, they are somewhat expensive to construct, as they are made of metal requiring seaming and have metal mouths and hasps to connect the top and bottom. Moreover, they require some dexterity to manipulate the hasps in order to couple the top and bottom portions. Further, they can become dented, which causes difficulty when attempting to secure the top and bottom together. Finally, the bottom portion may be difficult to pick up and carry with one hand.

SUMMARY OF THE INVENTION

These problems are largely solved by the fuel can of the present invention. It is provided with mating surfaces on the upper receptacle portion and the bottom tray, it preferably is constructed of resilient synthetic resin material which is rugged and resistant to impact, it readily couples together by the use of resilient latches, and it preferably includes a handle in the tray which not only aids in carrying but may support the bottom of the receptacle when the latter is filled with liquid.

As noted above, the invention hereof includes a receptacle, a tray, and structure for releasably coupling the receptacle and tray together. The coupling structure is preferably integrally formed or molded with the tray and the receptacle and includes a pair of opposed bosses associated with one of the aforementioned components and a corresponding pair of latching members associated with the other component. The tray and receptacle are configured with mating, respectively upper and lower margins which fit together to hold the two components together against relative lateral movement. The latch member is resiliently fixed to one of the components so that when the tray and receptacle are brought together, the latch members spread apart. When the two components are mated in a fully nested condition, the latch member is able return to substantially its previous position. The latch members each present a hook at the free end thereof for holding the boss in coupled relationship. The tray and receptacle are thus prevented from moving apart by the resilient characteristic of the latch member, and the complementally configured margins prevent the two components from moving apart in a transverse direction.

In preferred forms, the latch members are integrally formed with one of the tray and receptacle, while the bosses are integrally formed with the other of the tray and receptacle. The latch members and bosses are positioned at spaced intervals around the respective components, and preferably at opposite ends of the sides of the tray and receptacle. The latch members include a hook, which preferably is sloped along the remote surface thereof so that the sloped surface slides over the boss to spread the latch member during mating engagement of the receptacle with the tray. When fully mated, the hook snaps over a lip on the boss to hold the tray and receptacle together.

The tray, which is situated under the receptacle when the two are coupled, includes a handle positioned at the center thereof. Thus, the tray may be carried by only one hand. Further, the tray is positioned close to the bottom of the receptacle when the two are mated, so that if the receptacle is full of liquid and the bottom wall bows downwardly, the handle acts as a center support for the bottom wall. The bottom of the receptacle is further preferably provided with a plurality of transversely extending ribs molded therein to further stiffen the bottom against undesired distention.

These and other advantages of the present invention will be readily apparent with reference to the drawings and following description.

BRIEF DESCRIPTION OF THE DRAWINGS

FIG. 1 is a perspective view of the fuel can of the present invention, showing the tray component and the receptacle component coupled in mating engagement;

FIG. 2 is a top plan view of the receptacle component thereof;

DESCRIPTION OF THE PREFERRED EMBODIMENT

Figure 6:
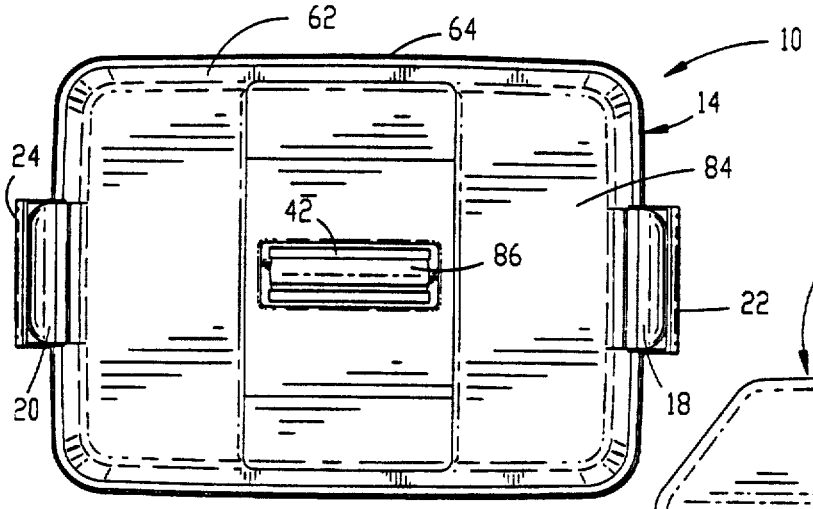
FIG. 6 is a bottom plan view thereof.
Figure 5:
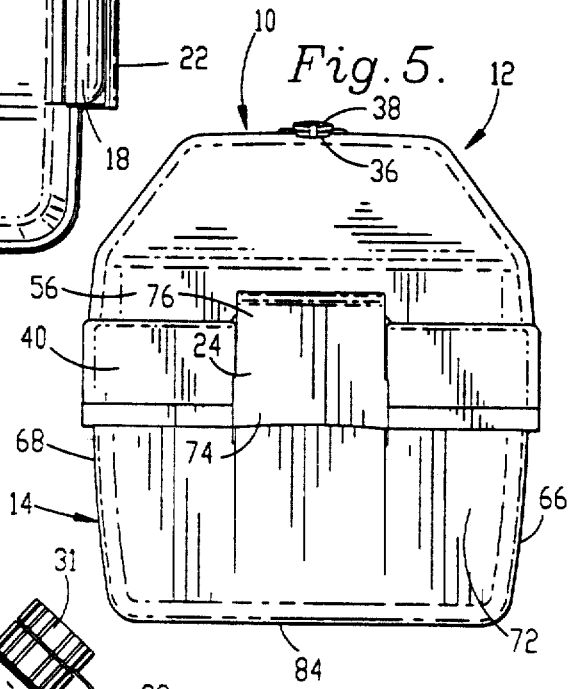
FIG. 5 is a rear elevational view thereof.
Figure 3:
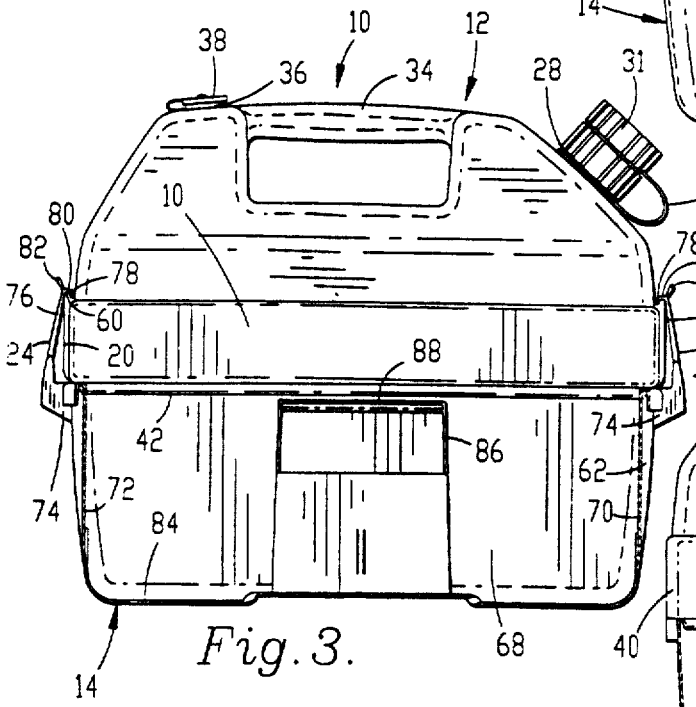
FIG. 3 is a left side elevational view of the fuel can hereof, with the tray shown in vertical section.
Figure 4:
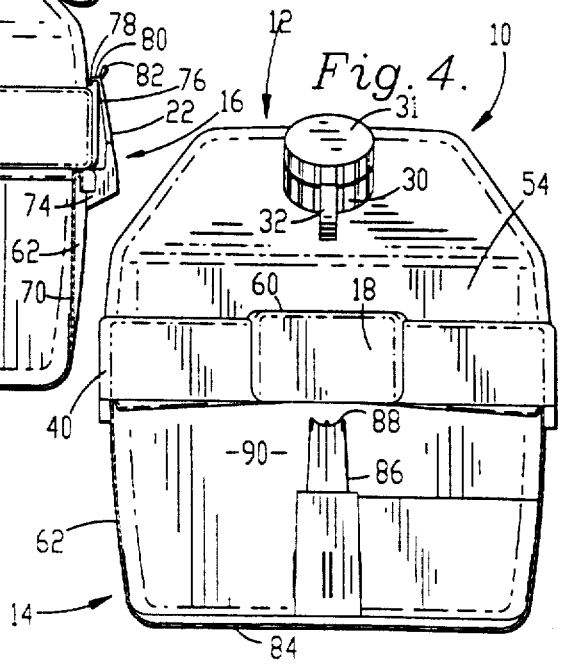
FIG. 4 is a front elevational view thereof with the tray component shown in vertical section to show the relationship between the bottom wall of the receptacle and the handle of the tray.

Referring now to the drawing, a fuel can 10 in accordance with the present invention broadly includes a receptacle component 12, a tray component 14, and coupling structure 16. The coupling structure includes a pair of bosses 18 and 20 formed on one of the tray and receptacle components, and a corresponding pair of latch members 22 and 24 formed on the other of the tray and receptacle components. While the drawing of the preferred embodiment shows the bosses formed on the receptacle and the latch members formed with the tray, it is to be understood that the bosses may instead be formed on the tray and the latches on the receptacle with an equivalent function and result.

The receptacle 12 is hollow for receiving fluid therein and includes receptacle top structure 26 defining a mouth 28 for receiving and discharging liquid therethrough. The mouth 28 is covered by a spout-retaining member 30 threaded onto the mouth, and a cap 31 which is threaded to the member 30 and retained on the mouth by harness 32. The structure 26 further presents a handhold 34 and a vent opening 36 which carries a vent cap 38 thereon. The handhold 34 is preferably hollow and thus allows fluid communication between the mouth 28 and the vent opening 36.

Figures 7, 8, 9, 10, 11, 12:
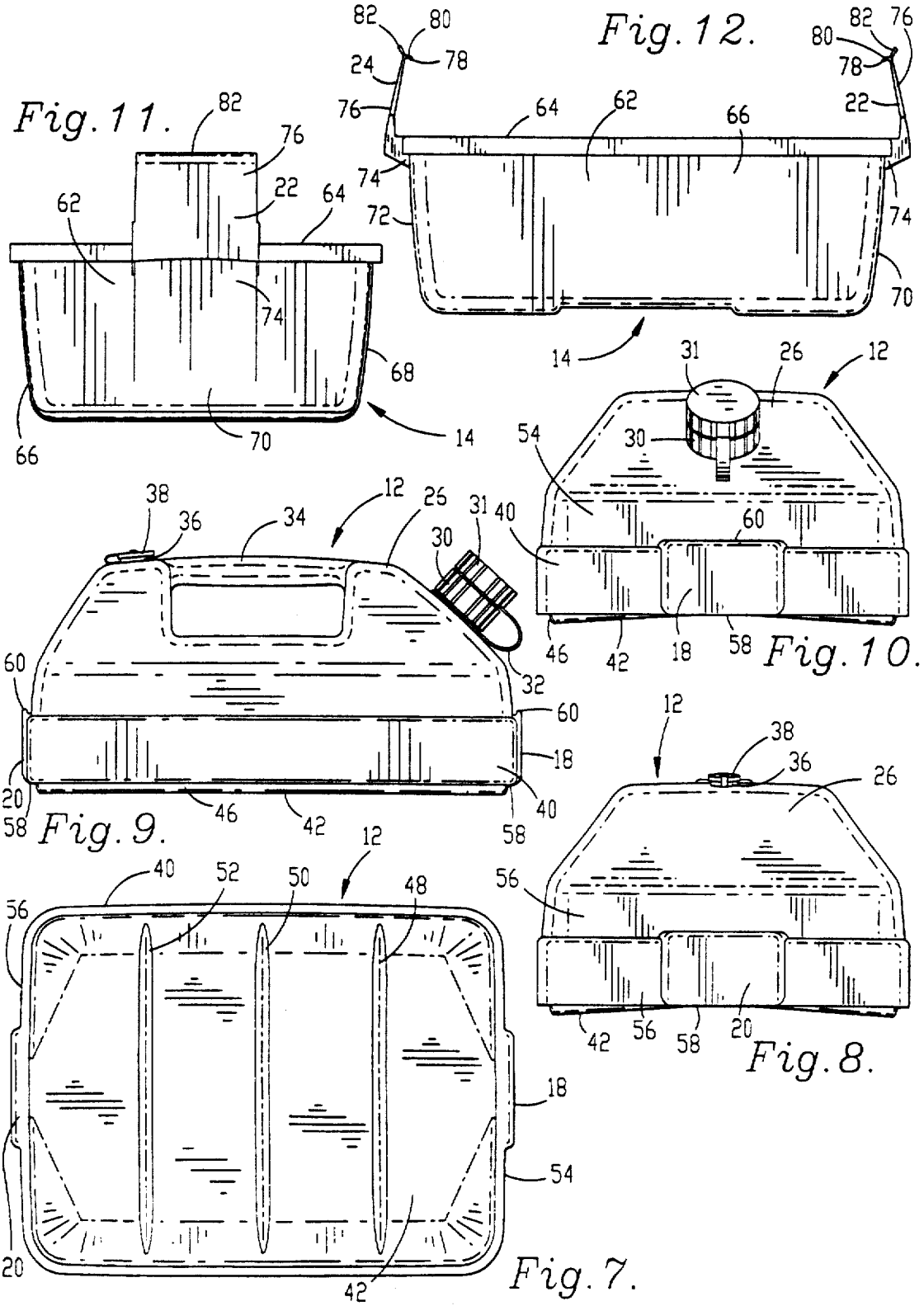
FIG. 7 is a bottom view of the receptacle component of the fuel can.
FIG. 8 is a rear elevational view of the receptacle component.
FIG. 9 is a left side elevational view of the receptacle component.
FIG. 10 is a front elevational view of the receptacle component.
FIG. 11 is an end elevational view of the tray component.
FIG. 12 is a side elevational view of the tray component.
Figure 14:
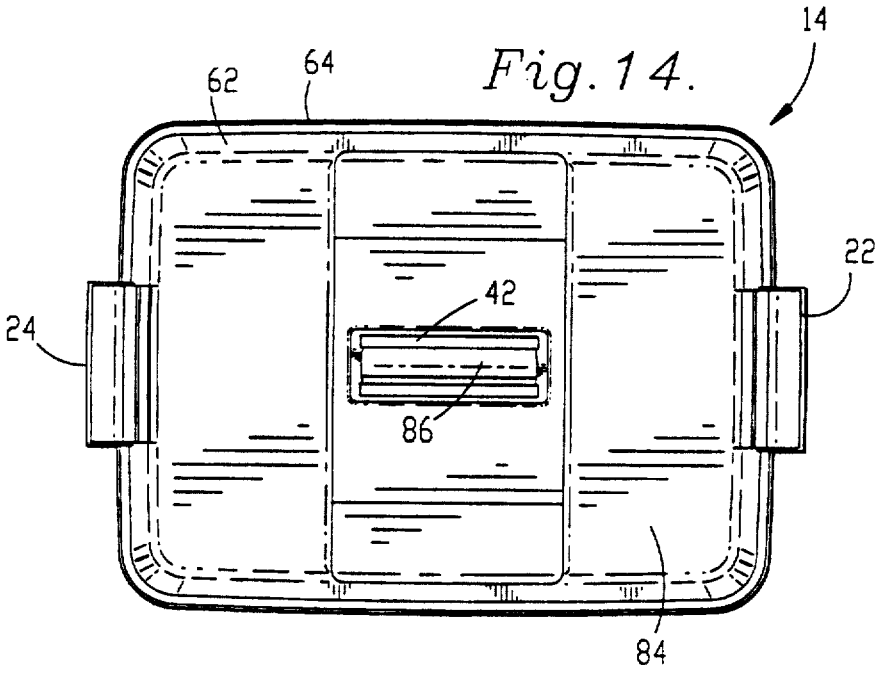
FIG. 14 is a bottom plan view of the tray component.

The receptacle 12 also includes a sidewall 40 which depends from the structure 26 and a bottom wall 42, best seen in FIG. 7. The bottom wall 42 presents a surrounding lower margin 44, the lower margin 44 having a groove 46 therein. The bottom wall 42 is slightly concave when the receptacle 12 is not filled with liquid, as shown in FIGS. 7 and 8, and include transversely extending ridges 48, 50 and 52 molded therein. The sidewall 40 includes first end 54 and second end 56, with boss 18 integrally formed into first end 54 and boss 20 integrally formed into second end 56. Each boss 18 and 20 includes a radiused or tapered lower edge 58 and an upwardly projecting lip 60.

The tray 14 is preferably substantially symmetrical about a bisecting longitudinal vertical plane and bisecting transverse vertical plane and includes surrounding tray wall 62. The tray wall 62 presents an upper margin 64 which is complementally configured with lower margin 44, whereby the upper margin 64 fits into groove 46 when the tray 14 and receptacle 12 are coupled in mating engagement. The portion of the lower margin 44 on the interior of the groove 46 engages the upper margin 64 when the tray 14 and receptacle 12 are nested in coupled relationship.

The tray 14 is preferably substantially rectangular when viewed in plan and tray wall 62 presents tray sides 66 and 68 and tray ends 70 and 72. Latch members 22 and 24 are integrally formed with tray ends 70 and 72 and extend upwardly beyond upper margin 64 and outwardly thereof. Each latch member 22 and 24 includes proximate portion 74 where the latch member joins with the tray wall 62 and free portion 76. The free portion or free end presents an inwardly facing hook 78, such that the hook 78 of latch member 22 faces hook 78 of latch member 24. Each hook 78 also has an inwardly sloping top surface 80 which is preferably smooth and extends upwardly to a tab 82 for grasping by a user to pull the hook 78 away from the respective boss 18 or 20 to spread the latch members and separate the receptacle 12 from the tray 14.

Figure 13:
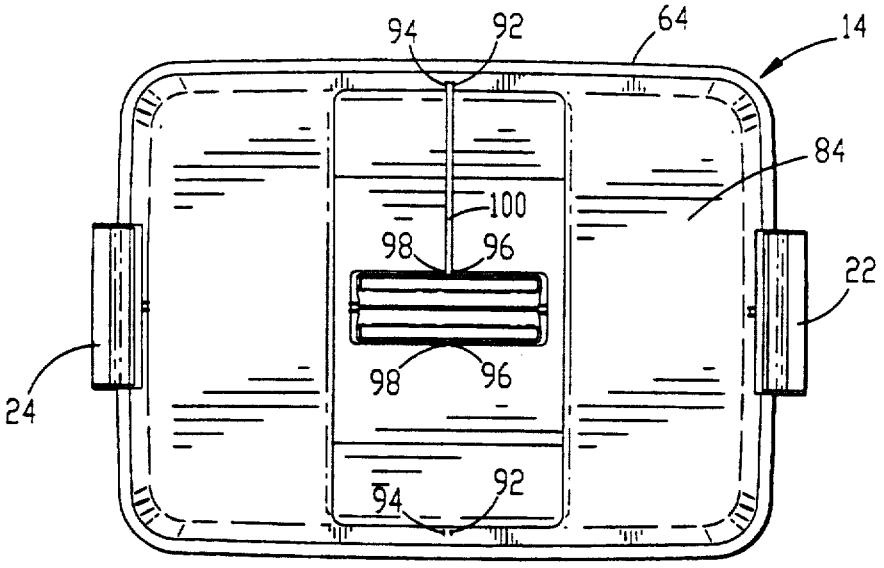
FIG. 13 is a top plan view of the tray component.

The tray also includes base 84 presenting a centrally located handle 86. The handle 86 includes an uppermost support surface 88 which is positioned proximate the bottom wall 42 when the receptacle 12 is coupled to the tray 14. A well 90 is defined in the area above the base 84 and between the handle 86 and the tray wall 62 for receiving tools and the like therein. The tray 14 includes nibs 92 and 94 molded on the interior of opposite tray sides 66 and 68 and corresponding tibs 96 and 98 molded on each side of handle 86 for holding an optional removable partition wall 100 within the well 90 as shown in FIG. 13.

Preferably, the fuel can 10 can be molded in only six separate components: the tray 14, receptacle 12, spout-retaining member 30, spout (not shown), cap 31, and vent cap 38. Each of the components is preferably molded of a resilient synthetic resin material such as polyethylene. The fuel can 10 is readily assembled by pressing the spout into the spout retaining member 30, fitting the harness 32 over the mouth of the receptacle 12, screwing the spout-retaining member 30 and then the screwing cap 31 onto the mouth, and snapping the vent cap 38 into place.

Uniquely, the receptacle 12 can be attached to the tray 14 by merely aligning the receptacle 12 with the tray 14 such that the lower edge 58 of each boss rests on the top surface 80 of a hook 78 and then pushing down on the receptacle 12. As the receptacle 12 is forced down, the bosses 18 and 20 cause the latch members 22 and 24 to spread apart. Because the latch members 22 and 24 are resilient, once the receptacle 12 is fully nested on the tray 14 with the upper margin 64 located in groove 46, the hooks 78 have cleared the respective lips 60 of the bosses 18 and 20, and snap into position over the lips 60 to hold the tray 14 and receptacle in coupled relationship. To separate the tray 14 and receptacle 12, the user need only grasp the handhold 34 and pull upwardly while pulling outwardly on one of the tabs 82. This frees the corresponding lip 60 and allows the user to free the receptacle 12 from the tray 14 in order to gain access to the latter or to pour liquid from the receptacle.

The tray 14 is advantageously configured so that tools and the like may be stored in the well 90 therein, and so that the tray may be carried with one hand by the centrally located handle 86. If the weight of the fuel or other liquid within the receptacle 12 causes the bottom wall 42 to deform by flexing downwardly, the supporting surface 88 engages the bottom wall 42 to prevent excessive flexing, and thus the handle 86 acts as a central support when the receptacle 12 is coupled to the tray 14. The resulting fuel can 12 is thus not only inexpensive to manufacture but useful and rugged in use as it resists dents and rusting and the tray and receptacle components are easily coupled and released.

I claim:

1. In a container of the type having a receptacle for holding liquids, a tray having a well for holding items, and means for coupling the receptacle and tray in a superposed relationship with the receptacle positioned above the tray, the improvement comprising:

the tray having a handle having an uppermost surface; and the receptacle having a flexible bottom wall presenting a lowermost surface located proximal to said uppermost surface, said lowermost surface being spaced apart from said handle when said receptacle is in an unfilled condition and flexing downwardly to contact said uppermost surface under influence of the liquid weight when said receptacle is in a filled condition, wherein said handle supports said receptacle in the filled condition.

2. The container as set forth in claim 1, said bottom wall having an upwardly concave structure in unfilled condition.

3. The container as set forth in claim 1, said bottom wall having rectangular dimensions presenting an axis of elongation, and including support ridges running transversely to the axis.

* * * * *